US011101094B2

(12) United States Patent
Guy

(10) Patent No.: US 11,101,094 B2
(45) Date of Patent: Aug. 24, 2021

(54) SAFETY SYSTEM

(71) Applicant: ZENNER-NETWORKS LTD., Harrow (GB)

(72) Inventor: David Guy, Harrow (GB)

(73) Assignee: ZENNER-NETWORKS LTD., Harrow (GB)

( * ) Notice: Subject to any disclaimer, the term of this patent is extended or adjusted under 35 U.S.C. 154(b) by 374 days.

(21) Appl. No.: 16/092,408

(22) PCT Filed: Apr. 7, 2017

(86) PCT No.: PCT/GB2017/050983
§ 371 (c)(1),
(2) Date: Oct. 9, 2018

(87) PCT Pub. No.: WO2017/175004
PCT Pub. Date: Oct. 12, 2017

(65) Prior Publication Data

US 2020/0328055 A1 Oct. 15, 2020

(30) Foreign Application Priority Data

Apr. 8, 2016 (GB) ..... 1606166

(51) Int. Cl.
*H01H 85/24* (2006.01)
*H01H 85/20* (2006.01)

(52) U.S. Cl.
CPC ..... *H01H 85/24* (2013.01); *H01H 85/20* (2013.01)

(58) Field of Classification Search
CPC ..... H01H 85/24; H01H 85/20; H01H 9/28; H01H 9/283; H01H 85/0208; H01H 85/22; H01H 85/2045; H01H 85/54
USPC ..... 337/205, 210, 216, 234, 253; 200/43.01, 200/43.02, 43.04, 43.05, 43.11, 200/43.13–43.16, 43.19, 43.21, 50.01, 200/50.07, 318, 325, 334
See application file for complete search history.

(56) References Cited

U.S. PATENT DOCUMENTS 5,207,590 A * 5/1993 Benda ..... H01H 85/24 337/210
5,477,016 A * 12/1995 Baginski ..... H01H 9/282 200/308

(Continued)

FOREIGN PATENT DOCUMENTS

AU 3715799 A * 11/1999 ..... H01H 85/24
GB 2322742 A 9/1998

(Continued)

OTHER PUBLICATIONS

Wilson; John Graham, "An Electrical Isolation Device", Nov. 16, 1999, British Nuclear Fuels PLC, Entire Document (Translation of AU 3715799, identical to WO 9956350—Attached). (Year: 1999).*

(Continued)

*Primary Examiner* — Stephen S Sul
(74) *Attorney, Agent, or Firm* — Cooley LLP

(57) ABSTRACT

A device and a system for preventing insertion of a fuse into a fuse holder, and methods for using the same. The device and the system comprise retaining elements that are adapted to engage with a fuse holder. When the device or system is engaged in a fuse holder, it is not possible to insert a fuse into the fuse holder. This allows for safe isolation of electric circuits.

19 Claims, 14 Drawing Sheets

(56) References Cited

U.S. PATENT DOCUMENTS

| | | | | |
|---|---|---|---|---|
| 5,556,305 | A | 9/1996 | Naegelin | |
| 5,844,186 | A * | 12/1998 | Meriwether | H01H 9/282 200/50.02 |
| 5,982,266 | A | 11/1999 | Sanford et al. | |
| 6,157,287 | A * | 12/2000 | Douglass | H01H 85/203 337/159 |
| 6,649,851 | B1 * | 11/2003 | Hennel | H01H 9/283 200/43.13 |
| 6,650,222 | B2 * | 11/2003 | Darr | H01H 9/104 337/187 |
| 6,703,572 | B1 * | 3/2004 | Broghammer | H01H 9/282 200/43.11 |
| 6,727,797 | B1 * | 4/2004 | Bruchmann | H01H 9/104 337/194 |
| 9,224,548 | B2 * | 12/2015 | Dunker | H01H 3/02 |
| 9,613,776 | B2 * | 4/2017 | Brakefield | H01H 85/143 |
| 10,354,812 | B1 * | 7/2019 | Enger | H01H 9/283 |
| 2005/0224323 | A1 * | 10/2005 | Bortolloni | H01H 9/22 200/50.05 |
| 2008/0261426 | A1 * | 10/2008 | Diekmann | H01R 9/265 439/189 |
| 2009/0071804 | A1 * | 3/2009 | Drake | H01H 9/282 200/43.14 |
| 2010/0259355 | A1 * | 10/2010 | Buettner | H01H 85/547 337/187 |
| 2012/0019346 | A1 * | 1/2012 | Levi | H01H 85/22 337/214 |
| 2014/0165384 | A1 * | 6/2014 | Dudgeon | H01H 9/283 29/622 |
| 2014/0176164 | A1 * | 6/2014 | Davis | G01N 27/223 324/709 |

FOREIGN PATENT DOCUMENTS

| | | |
|---|---|---|
| WO | WO 99/56350 A1 | 11/1999 |
| WO | WO 99/56351 A1 | 11/1999 |

OTHER PUBLICATIONS

International Search Report issued for PCT/GB2017/050983, dated Oct. 9, 2018.

International Preliminary Report on Patentability issued for PCT/GB2017/050983, dated Jul. 14, 2017.

GB Search Report issued for Application Serial No. GB1606166.5 dated Oct. 11, 2016.

Australian Examination Report issued for Application Serail No. AU2017245897, dated Apr. 8, 2019.

* cited by examiner

SAFETY SYSTEM

The present application is a U.S. 371 national stage application of PCT/GB2017/050983, having an international filing date of 7 Apr. 2017, which claims priority to United Kingdom patent application no. GB1606166.5, filed 8 Apr. 2016, each disclosure of which, in its entirety, is incorporated herein by reference.

FIELD OF INVENTION

The invention relates to a safety system for preventing the insertion of a fuse into a fuse holder, and a method of using said system.

BACKGROUND

Signalling systems used on railways consist of many electrical circuits that interact with each other in order to keep trains a safe distance apart. All electrical circuits are protected with an overcurrent device at the beginning of the circuit; older systems will use a cartridge fuse whereas modern systems will use a lockable resettable device. These electrical circuits can be spread over a plurality of large areas and can be found in rooms, buildings, kiosks and trackside locations. It is common for a circuit to encompass all or a combination of the above mentioned locations. When circuits enter or leave a location an overcurrent protection device will be used, this enables isolation of sections of circuits either side of that location. Regular maintenance and fault rectification activities are undertaken on these circuits. In order to conduct these activities safely, operatives will either completely or partly electrically isolate a circuit or areas to be worked on by removing the overcurrent protection device on the boundaries of the location or the main overcurrent device at the beginning of the circuit, thereby stopping the flow of electrical current through the relevant circuit(s). Due to the sheer number of circuits that are involved in maintaining a safe railway it is common for overcurrent protection devices to be lined up in bays in the afore-mentioned locations.

The older signalling systems that use cartridge fuses have no physical means of preventing a cartridge fuse being replaced if one was removed in order to create a safe working environment.

Currently operatives undertake a course in the safe isolation of circuits, and this course outlines the need to ensure that a circuit cannot be reinstated while operatives are working on that section. This course states that if you are unable to use a physical means of securing an isolation then a person trained in safe isolation procedures is required to guard to circuit, for as long as needed, to ensure that the safe isolation remains in place.

Due to the scale and quantity of circuits involved in an operational railway the number of overcurrent device can be very large. Also, a number of operatives from different departments may be working on the circuits at the same time. The operatives working on these circuits, or parts of circuits, may require various different levels of isolation on the same circuits. This can lead to an operative reinstating an overcurrent protection device to a circuit or section of a circuit that they believed was under their control, when in fact it was in place for a different workgroup.

Accordingly, there exists a need to provide a system to protect further against the untimely reinstatement of a cartridge fuse due to, e.g., human error, and reduce the associated risks.

SUMMARY OF INVENTION

There is herein described a safety device and a safety system that, when placed in an empty fuse holder, physically restricts an operative from reinstating a fuse into the holder. Accordingly, use of the device or system facilitates a safer working environment when, e.g., regular maintenance and fault rectification activities are undertaken on electrical circuits such as low voltage signalling circuits or high voltage power circuits. In use, the safety device or safety system is anchored to existing infrastructure and circuitry.

In accordance with an aspect of the invention, there is provided a device for preventing insertion of a fuse into a fuse holder, the device comprising: two retaining elements that are capable of engaging with a fuse holder, and a resilient member situated between the two retaining elements, wherein the retaining elements are moveable relative to each other between an engaged and a released position, such that in the engaged position the resilient member exerts pressure on the two retaining elements thereby urging them apart, and in the released position the retaining elements are moved towards each other and the resilient member is compressed.

Conveniently, the resilient member is a spring, such as a helical or coil spring.

Each retaining element may comprise an actuator tab, a stem region, and a foot, wherein the actuator tab and the foot are at respective ends of the stem region, and the foot and the actuator tab lie in a plane that is perpendicular to a longitudinal axis of the stem region.

The device may comprise a core body, wherein there is a cavity in the core body, and the dimensions of the cavity are such that it houses the stem region of the retaining elements and the resilient member, and allows for movement of the retaining elements encompassed therein in a single plane along the longitudinal axis of the device between the released and engaged positions.

Advantageously, the core body is shaped for insertion into the fuse holder. Typically, a fuse holder has metal clips at either end for gripping/mounting a cylinder fuse. Accordingly, the core body may comprise a cylindrical element, or may be cylindrical, for insertion into the fuse holder. Preferably, the cylindrical element mimics the shape of a fuse, e.g., a cartridge fuse. When the cylindrical element is inserted into the fuse holder it deforms the metal clips in the fuse holder by pushing against them in the same manner as a fuse. Furthermore, the cylindrical element sits between either end of the fuse holder and physically prevents an operative from inadvertently coming into contact with the electrically live metal clips of the fuse holder.

The two retaining elements are capable of engaging with the two ends of the fuse holder, respectively. The use of two retaining elements allows for each end of the fuse holder to be engaged with a retaining element, which enables the system to be anchored more securely in the fuse holder.

Conveniently, the device comprises an aperture, and the dimensions of the aperture are such that the actuator tabs of the retaining elements protrude through the aperture. The aperture allows for the actuator tabs to move in a single plane along the longitudinal axis of the device on compression and release of the resilient member, i.e., between the released and engaged positions.

Advantageously, the foot of each retaining element is capable of engaging with the fuse holder by means of a plurality of projections, preferably two projections, more preferably three projections. Preferably, these projections engage with the fuse holder by interacting with the metal fuse clip that is present at each end of the fuse holder. The projections slide into place along the base of the fuse holder so as to interdigitate with the arms of the fuse clip. If there are two projections, these projections may engage with the metal fuse clip by sitting at the base of the fuse clip, with one projection outside each arm of the fuse clip. The curvature of the metal fuse clip (which is augmented by mounting the cylindrical element of the core body in the metal clips) prevents the projections from moving away from the base of the fuse clip towards the tips of the arms of the fuse clips. If there are three projections, the third projection sits as the base of the clip, in between the two clip arms. This middle projection helps to guide and orientate the foot when the foot and associated projections are slid into place to engage with the fuse clip.

The device cavity may comprise a recessed groove, and the retaining elements may comprise a corresponding ridge, wherein the ridge and the groove interlock. The ridge slides along in the groove in a single plane along the longitudinal axis of the device on compression and release of the resilient member. Preferably, the ridge protrudes from the stem region of each of the two retaining elements. This interaction helps to guide the retaining elements between the engaged and released position.

Each of the retaining elements may comprise a notch. The dimensions of the notch are such that each end of the resilient members sits in the notch of the respective retaining element. Preferably the notch is in the stem region of each of the two retaining elements. The notches keep the resilient member, and the force it exerts, perpendicular to the stem region of the retaining elements.

Optionally, each of the two retaining elements further comprise a locking tab comprising an indent or hole, wherein the locking tab lies in a plane that is perpendicular to a longitudinal axis of the stem region of the retaining elements. In the engaged position the indent or hole in each of the locking tabs aligns with an aperture that runs from one side of the core body to the other, thereby allowing for a securing member to pass through the aperture and fix the retaining elements in situ. The retaining elements are immobilized in the engaged position when the securing member, e.g., a padlock, tie or locking means, is in place. Accordingly, when the device is in a fuse holder in the engaged position it is immobilized by the securing member; the device cannot be removed from the fuse holder without removing the securing member. This provides a further security and safety measure for operatives working on isolated circuits.

The device may comprises a cover element. The cover element may span the length of the fuse folder, so as to protect an operative from having direct contact with the fuse holder.

Conveniently, the leading edge of the actuator tabs is angled. The edge is angled away from the ends of the device. For example, the actuator tabs are chamfered. This angle facilitates the movement of the actuator tabs into the released position when pressure, e.g., from a fuse puller, is applied to the actuator tabs.

Optionally, the device is configured to be gripped by a fuse puller by means of one or more ridges on the outside of the device which demarcate the areas where the fuse puller contacts the device. In use, the fuse puller presses the actuator tabs of the retaining elements, thereby moving the retaining elements from the engaged position to the released position.

The device, optionally with the exception of the resilient member, is non-conductive. The device is electrically neutral. It provides an insulated shield that extends beyond the fuse holder and protects the operative from coming into contact with the electrically live exposed metal work that makes up the fuse holder.

In accordance with the invention there is provided a method of using the device for preventing insertion of a fuse into a fuse holder, wherein the method comprising the steps:

(i) press the actuator tabs of the retaining elements towards each other, optionally using fuse pullers, thereby moving the retaining elements towards each other and compressing the resilient member, (ii) place the core body of the device in the fuse holder;

(iii) release the actuator tabs of the retaining elements, thereby allowing the resilient member to return to its extended shape and urge the retaining elements away from each other such that the retaining elements engage with the respective ends of the fuse holder;

optionally further comprising the step of:

(iv) secure the locking tabs of the retaining elements with a locking member to fix the device in situ.

The device of the invention may be manufactured by various methods including plastic injection moulding or 3D printing. Such methods are routine to the person skilled in the art. The device may be made from a thermoplastic resin. Preferably, the device is made from a material with a high Comparative Tracking Index (CTI), e.g., 400≤CTI≤600, or 600≤CTI. CTI is used to measure the electrical breakdown properties of an insulating material, i.e., the electrical insulating properties of a material. The CTI testing method is specified in IEC standard 60112. The material may be Crastin® (DuPont™), such as Crastin® HR5330HFS NC10.

In accordance with a further aspect of the invention there is provided a system for preventing insertion of a fuse into a fuse holder, the system comprising: one or more retaining elements that are capable of engaging with a fuse holder; and a cover element which receives and immobilizes the or each retaining element and prevents the or each retaining element from disengaging from the fuse holder, wherein the cover element prevents insertion of a fuse into the fuse holder.

The or each retaining element may comprise a tab, a stem region, and a foot, wherein the tab and the foot are at respective ends of the stem region, and the foot lies in a plane that is perpendicular to a longitudinal axis of the stem region. The tab, stem region and foot components of the retaining element are joined together such that they cannot move or rotate around a longitudinal axis of the stem region in isolation from each other.

The system may further comprise a core body, wherein a slot runs through the core body from the underside to the upperside of the core body, and the dimensions of the slot are such that: the tab of the or each retaining element can pass through the slot in a particular orientation; the stem region of the or each retaining element can rotate on a longitudinal axis within the slot; and the foot of the or each retaining element cannot enter the slot, wherein the rotation of the stem region enables the retaining element to be orientated such that: the foot engages with the fuse holder, and the tab prevents release of the retaining element from the slot in the core body.

Preferably the core body is shaped for insertion into the fuse holder. For example, a fuse holder has metal clips at either end for gripping/mounting a cylinder fuse. Accordingly, the core body may comprise a cylindrical element for insertion into the fuse holder. Preferably, the cylindrical element mimics the shape of a fuse, e.g., a cartridge fuse. When the cylindrical element is inserted into the fuse holder it deforms the metal clips in the fuse holder by pushing against them in the same manner as a fuse. Furthermore, the cylindrical element sits between either end of the fuse holder and physically prevents an operative from inadvertently coming into contact with the electrically live metal clips of the fuse holder. Optionally, the core body may further comprise a platform element.

Conveniently, the system comprises two retaining elements that are capable of engaging with the two ends of the fuse holder, respectively, and wherein the cover element immobilizes the two retaining elements relative to each other. The use of two retaining elements allows for each end of the fuse holder to be engaged with a retaining element. This enables the system to be anchored more securely in the fuse holder once the cover element has been attached so as to hold the retaining elements in position.

The cover element may comprise one or more apertures for receiving the tab of the or each retaining element, wherein the shape of the or each aperture is such that it receives the tab only when the tab is in a particular orientation, and wherein the aperture prevents movement of the or each retaining element and the core body relative to each other. Preferably, the shape/dimensions of the tab of the retaining element and the shape/dimensions of the aperture are such that the tab fits snugly within the aperture so as to hold the retaining elements firmly in place. The tab may or may not protrude through the aperture, beyond the cover element. Preferably, the tab protrudes through the aperture.

The system may comprise a cover element comprising two apertures and two retaining elements. The apertures are spaced apart on the cover element at a pre-determined interval so as to hold the respective retaining elements in the appropriate position to enable their engagement with the ends of the fuse holder.

When the system is fitted in a fuse holder, i.e., when it is 'in use', the tabs of the retaining elements are orientated such that they are received by the apertures in the cover element. This 'in use' orientation of the tab also prevents the tab from sliding back through the slot in the core body. Furthermore, when the tab of the retaining element is in the 'in use' orientation, the foot of the same retaining element is necessarily orientated such that it engages with the fuse holder.

In accordance with an embodiment of the invention there is also provided a system for preventing insertion of a fuse into a fuse holder, wherein the system comprises: one or more retaining elements, each retaining element comprising a tab, a stem region, and a foot, wherein the tab and the foot are at respective ends of the stem region, and the foot lies in a plane that is perpendicular to a longitudinal axis of the stem region; and a cover member that comprises one or more apertures wherein the or each aperture is shaped to receive the tab of the respective retaining member only in a particular orientation, whereby association of the tab with the aperture holds the foot of the retaining member in a particular orientation and prevents movement of the retaining member.

Preferably, the system comprises two retaining elements and the cover member comprises two respective apertures spaced at a pre-determined interval The system may further comprise: a core body, wherein a slot runs through the core body from the underside to the upperside of the core body, and the dimensions of the slot are such that: the tab of the or each retaining element can pass through the slot in a particular orientation; the stem region of the or each retaining element can rotate on a longitudinal axis within the slot; and the foot of each retaining element cannot enter the slot, wherein the rotation of the stem region enables the retaining element to be orientated such that: the foot is capable of engaging with a fuse holder, the tab prevents the release of the retaining element from the slot in the core body, and the tab is orientated to be received by the respective aperture in the cover member.

Advantageously, the system of the invention further comprises a locking tab, wherein the locking tab secures the system components in situ. That is, the locking tab fixes the system in the fuse holder. It also further prevents against relative movement of the system components. The locking tab may be attached to the core body, optionally it is attached to the platform element of the core body, and it interacts with the cover element. The cover element receives the locking tab though a locking aperture and the locking tab protrudes beyond the cover element. The locking tab may comprise a securing aperture that is accessible when the locking tab protrudes beyond the cover element. A padlock or tie or other securing means may be threaded through this securing aperture to prevent the cover element and the locking tab from disengaging. This, in turn, secures the cover element such that it is immobilized in place with respect to the core body and the retaining elements. Furthermore, advantageously, the 'locked' system is anchored in place in the fuse holder. It cannot be removed from the fuse holder without undoing the padlock, tie or locking means. This provides a further security and safety measure for operatives working on isolated circuits. Alternatively, the locking tab may extend from the tab of the retaining element. Optionally, the locking tab may comprise wings (rather than a securing aperture) that expand outwardly to create an arrow-like shape, meaning that the locking tab can only move through the aperture in a single direction. Once the tab has protruded beyond the locking aperture, the wings expand and prevent the tab from retreating back through the locking aperture.

The foot of the or each retaining element may be capable of engaging with the fuse holder by means of a plurality of projections, preferably two projections, more preferably three projections. Preferably, these projections engage with the fuse holder by interacting with the metal fuse clip that is present at each end of the fuse holder. The projections slide into place along the base of the fuse holder so as to interdigitate with the arms of the fuse clip. If there are two projections, these projections may engage with the metal fuse clip by sitting at the base of the fuse clip, with one projection outside each arm of the fuse clip. The curvature of the metal fuse clip (which is augmented by mounting the cylindrical element of the core body in the metal clips) prevents the projections from moving away from the base of the fuse clip towards the tips of the arms of the fuse clips. If there are three projections, the third projection sits as the base of the clip, in between the two clip arms. This middle projection helps to guide and orientate the foot when the foot and associated projections are being slid into place to engage with the fuse clip.

The dimensions of the slot in the core body allows for movement of the retaining elements encompassed therein in a single plane perpendicular to a longitudinal axis of the stem region of the retaining element. The slot helps to guide the retaining elements into and out of engagement with the fuse holder when the system is being inserted into and removed from a fuse holder, respectively.

The stem region of the retaining element may have a circular cross-section. The diameter of the cross-section is narrower than length and width of the retaining element tab. The cylindrical stem region can rotate freely (when the tab and foot of the retaining element is not secured in place) within the slot of the core body. The advantage of a circular, or substantially circular, cross-section is that the dimensions of the slot in the core body can be closely based on the shape of the tab without hindering the rotation of the stem region.

Optionally, the cover element comprises a central aperture for receiving the or each tab of the or each retaining element, wherein the shape of the central aperture is such that it receives the or each tab only when the or each tab is in a particular orientation and prevents the or each retaining element from engaging with the fuse holder. Advantageously, this central aperture prevents the feet of the retaining elements from getting caught in the metal clips of the fuse holder when the retaining elements are moved into and out of the fuse holder, i.e., prior to, or after, sliding the foot elements along the base of the fuse holder to interdigitate with, or disengage from, the metal clips, respectively.

Preferably, the cover element, core body and retaining elements are non-conductive. The system is electrically neutral. The non-conductive cover element provides an insulated shield that extends beyond the fuse holder and protects the operative from coming into contact with the electrically live exposed metal work that makes up the fuse holder.

In another aspect of the invention, there is provided a distribution board comprising a fuse holder and the system or device of the invention, wherein the system or device is anchored within the fuse holder.

In a further aspect of the invention, there is provided a method for using the system of the invention for preventing insertion of a fuse into a fuse holder. Optionally, the method comprises initial assembly steps:

(i) insert the retaining elements into the core body by inserting the tab, orientated such that it fits into the slot, and the stem of each retaining element through the slot in the core body;

(ii) rotate the retaining elements such that the tab holds the retaining element within the core body.

The method then comprises the steps:

(iii) place the core body in the fuse holder;

(iv) slide the retaining elements to the outer ends of the slot such that the retaining elements engage with the respective ends of the fuse holder;

(iv) place the cover element onto the retaining elements such that the tabs of the retaining elements are received by the respective apertures on the cover element.

When the system comprises a locking tab, the method may further comprise the step of:

(iv) secure the locking tab to fix the system in the fuse holder and further prevent relative movement of the system in situ.

The system of the invention may be manufactured by various methods including plastic injection moulding or 3D printing.

DESCRIPTION OF FIGURES

The invention will now be described solely by way of example and with reference to the accompanying drawings in which.

DETAILED DESCRIPTION

Figure 1:
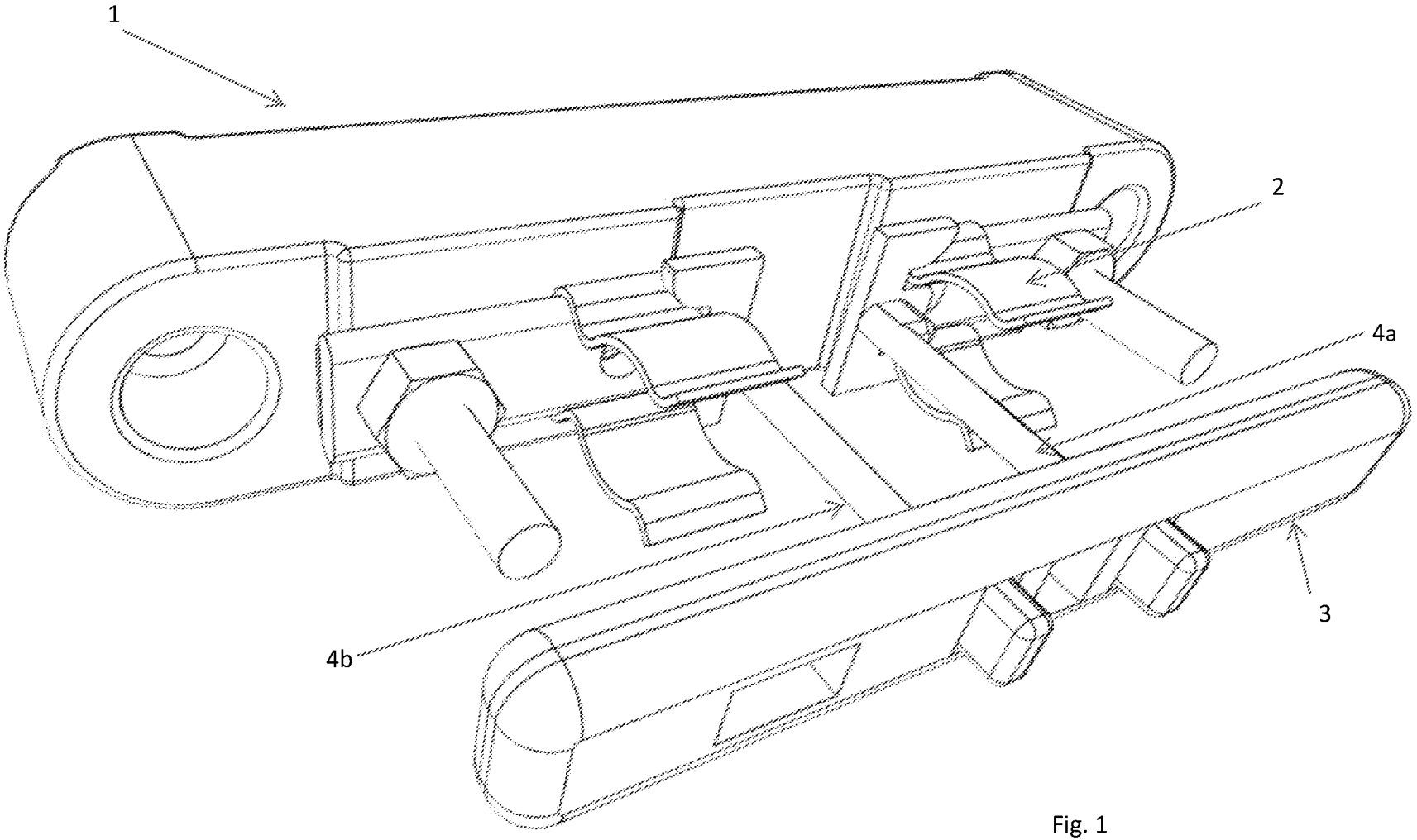
FIG. 1 shows a system of the invention comprising two retaining elements and a cover element, wherein the system is mounted on a fuse holder.
Figure 2A:
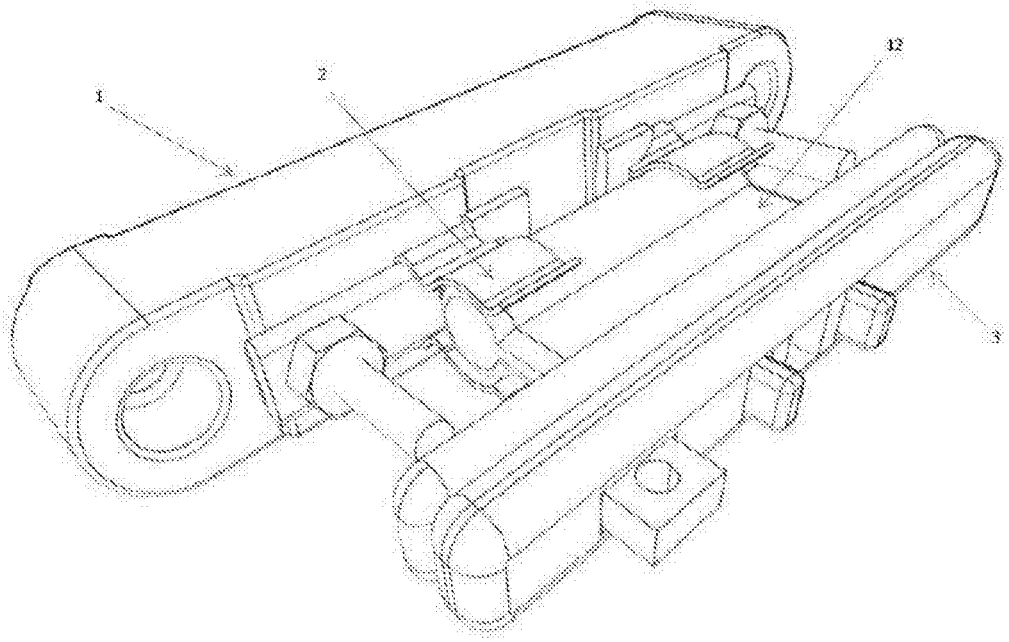
FIGS. 2A and 2B show a system of the invention comprising two retaining elements, a core body and a cover element.
Figure 2B:
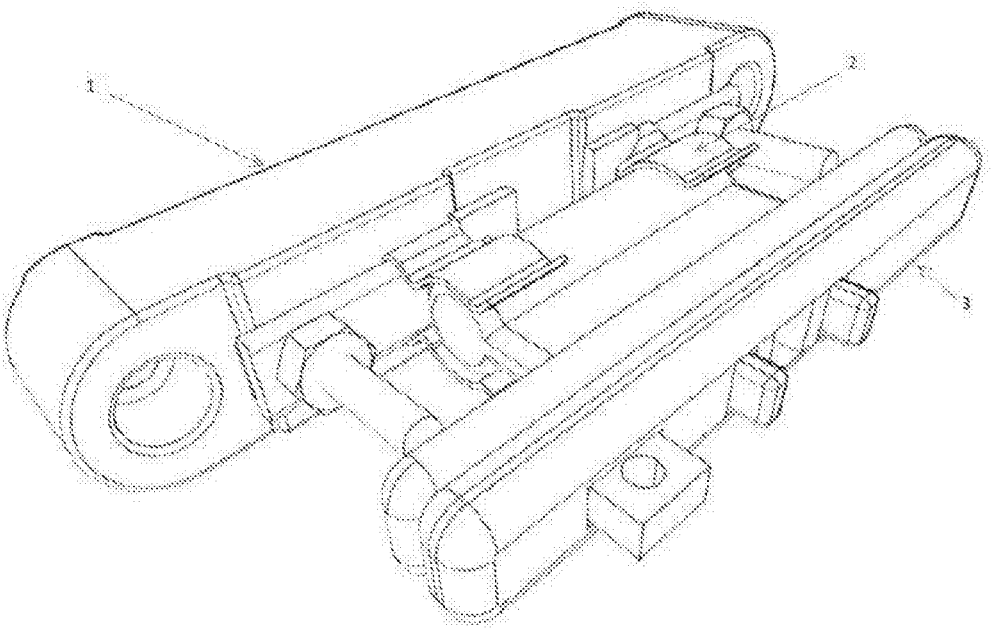

Electrical supply systems, such as signalling systems comprise distribution boards to divide an electrical power feed into subsidiary circuits. Such distribution systems may comprise a plurality of fuse holders, wherein the fuse holders have a metal clip at either end to mount a cartridge fuse. FIGS. 1, 2A and 2B exemplify a single fuse holder (1) having metal clips (2) at each end.

The invention provides a safety device (17) for use in safely and securely isolating one or more subsidiary circuits. The circuit is isolated by removal of the cartridge fuse. The safety device (17) prevents the untimely re-insertion of a cartridge fuse into the fuse holder (1) so as to protect operatives working on the isolated circuit.

Figure 8A:
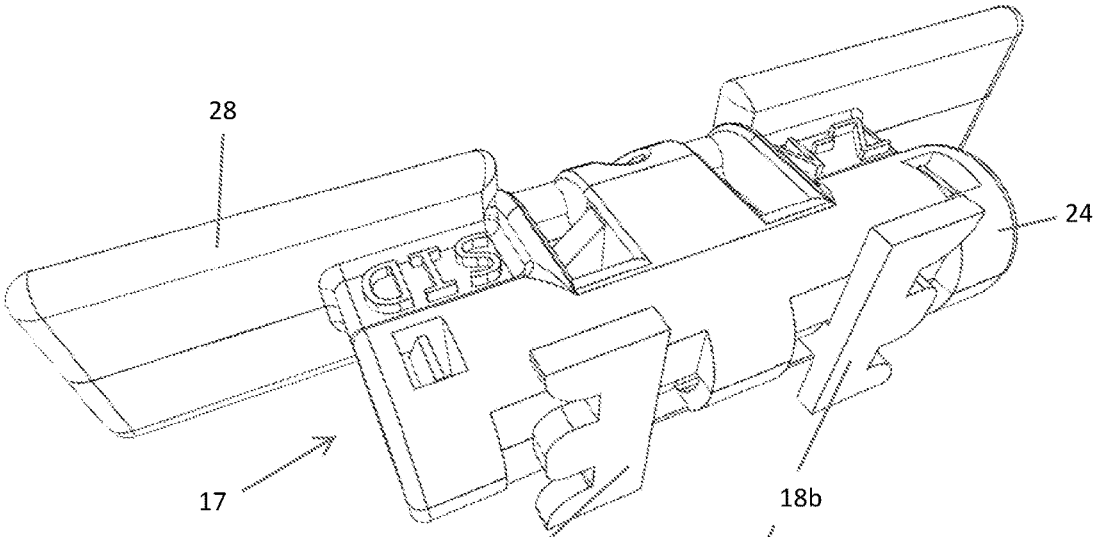
FIGS. 8A, 8B and 8C show the device of the invention from various perspectives.
Figure 8B:
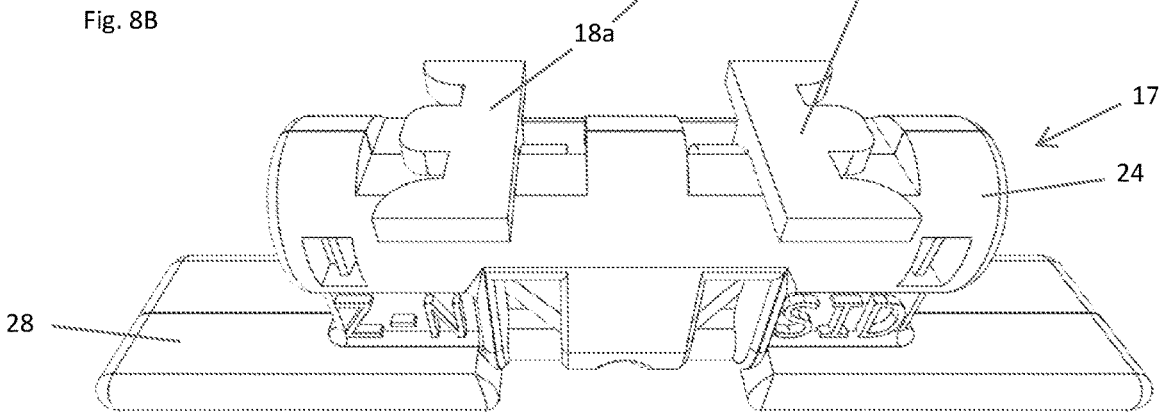
Figure 8C:
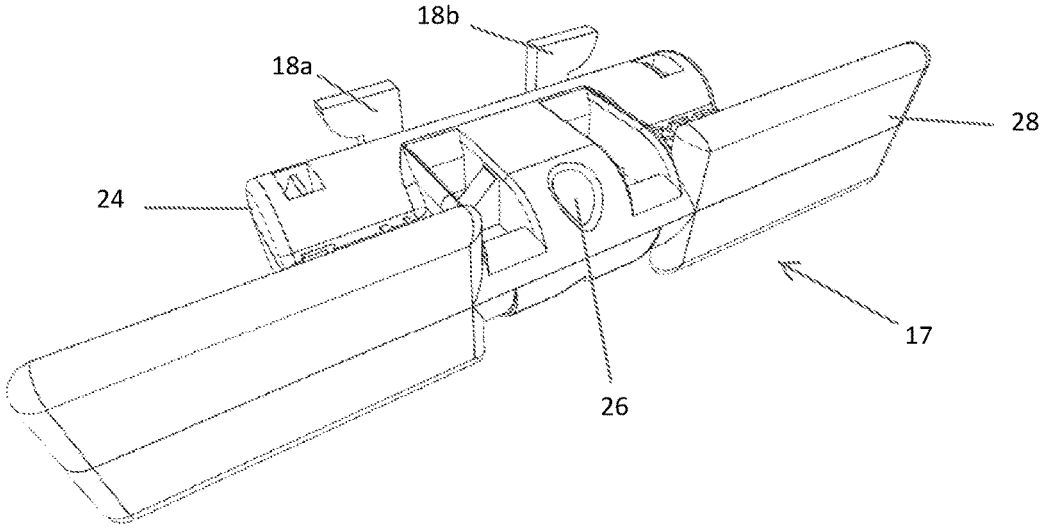
Figure 9A:
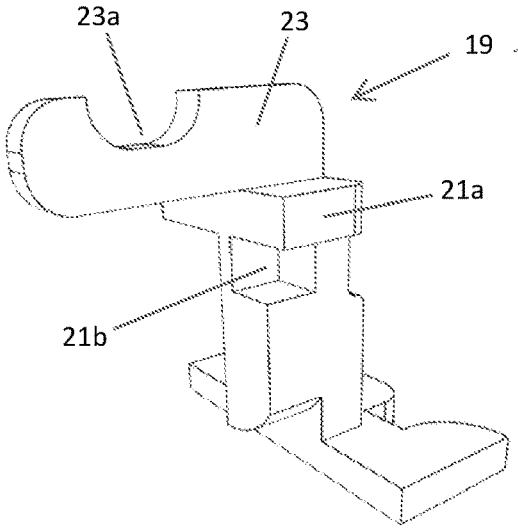
FIGS. 9A, 9B, 9C, 9D, 9E and 9F show the retaining element of the device from different perspectives.
Figure 9B:
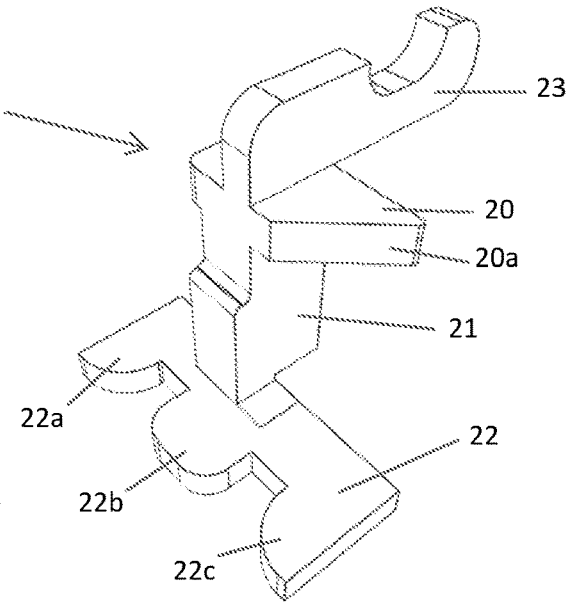
Figure 9C:
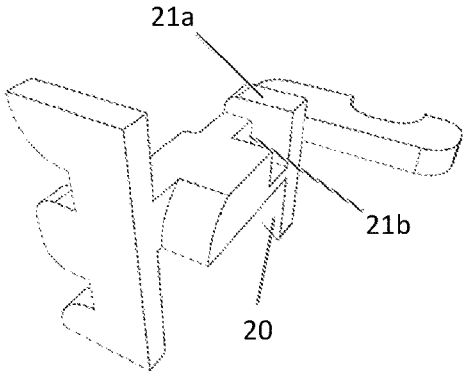
Figure 9D:
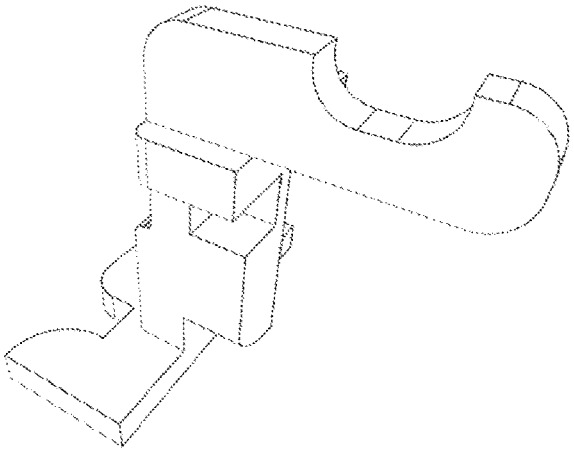
Figure 9E:
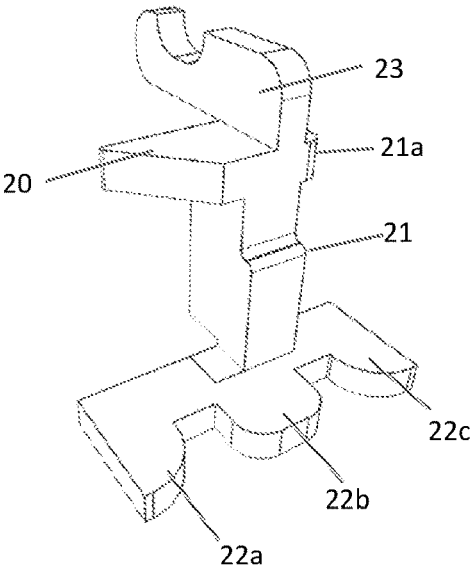
Figure 9F:
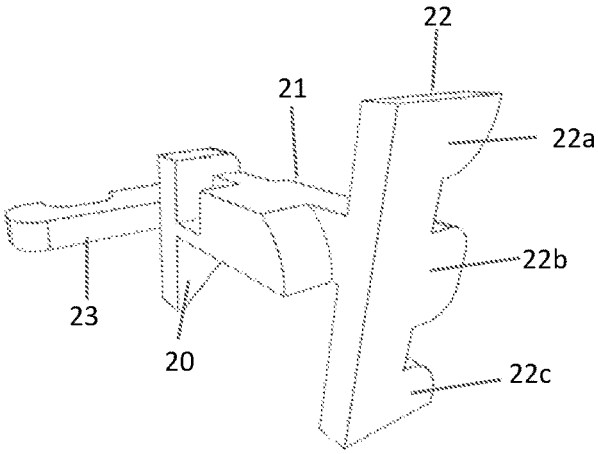

FIGS. 8A, 8B and 8C show a device (17) comprising two retaining elements (18*a*, 18*b*). A spring (19) (not shown in FIGS. 8A, 8B and 8C) is situated between the two retaining elements (18*a*, 18*b*), such that the spring (19) is perpendicular to the retaining elements (see FIG. 12A). The two retaining elements (18*a*, 18*b*) are movable between an engaged position, which is depicted in FIGS. 8A, 8B, 8C, and 14C, and a released position, as shown in FIG. 14B. In the engaged position the spring (19) exerts pressure on the two retaining elements (18*a*, 18*b*) thereby urging them apart. In the released position the retaining elements (18*a*, 18*b*) are moved towards each other and the spring (19) is compressed.

As shown in FIGS. 9A-9F, 13A and 13B, each retaining element (18) comprises an actuator tab (20), a stem region (21), a foot (22) and a locking tab (23). The actuator tab (20) has an angled, chamfer edge (20*a*). The stem region (21) comprises a ridge (21*a*) and a notch (21*b*). The foot comprises three projections (22*a*, 22*b*, 22*c*). The locking tab (23) comprises an indent (23*a*).

Figure 10A:
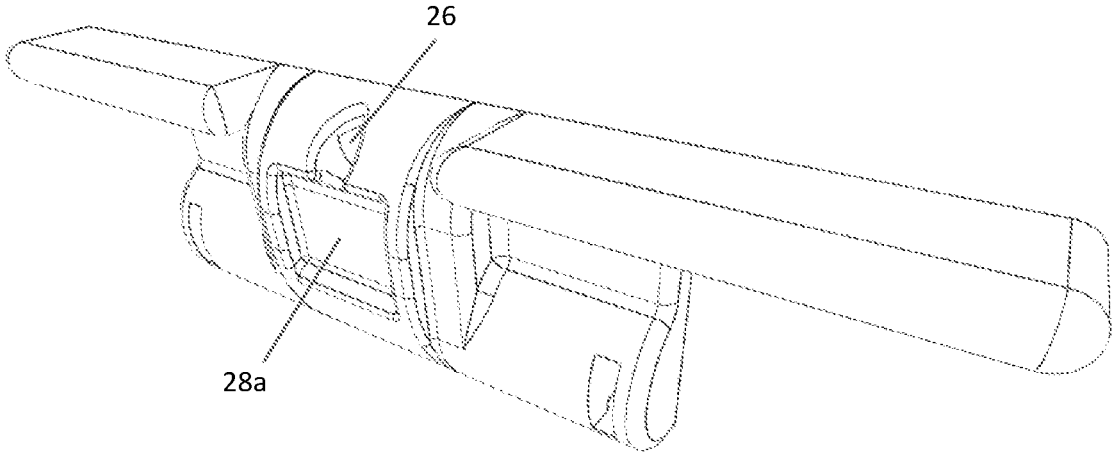
FIGS. 10A, 10B and 10C show a first part of the device from various perspectives.
Figure 10B:
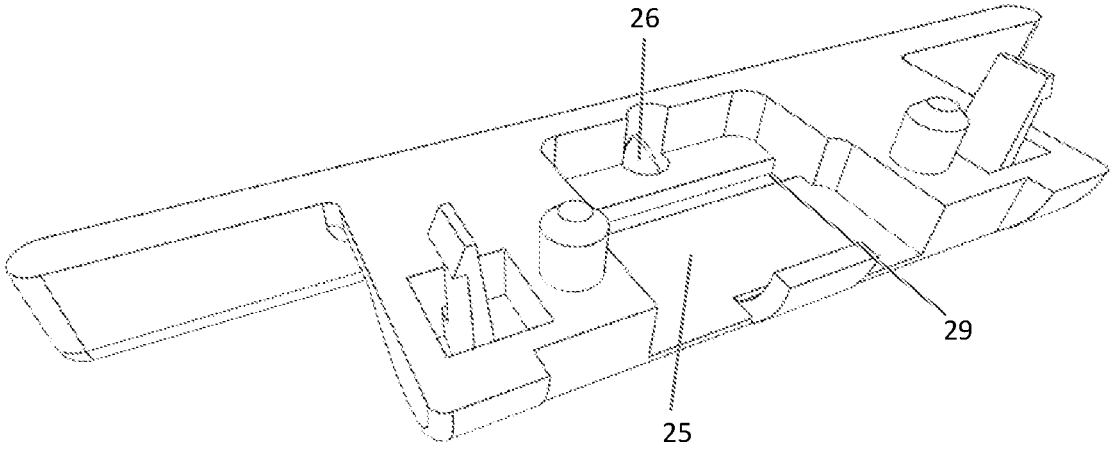
Figure 10C:
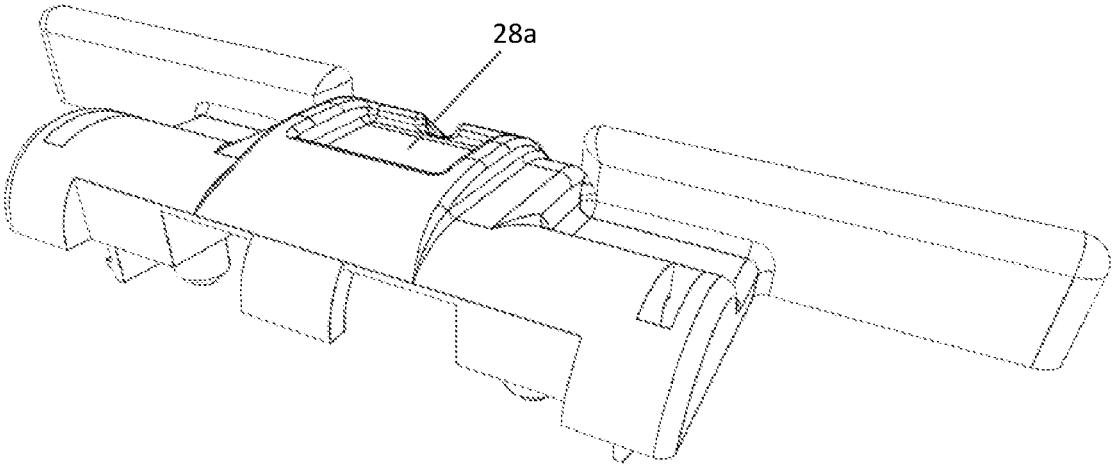
Figure 11A:
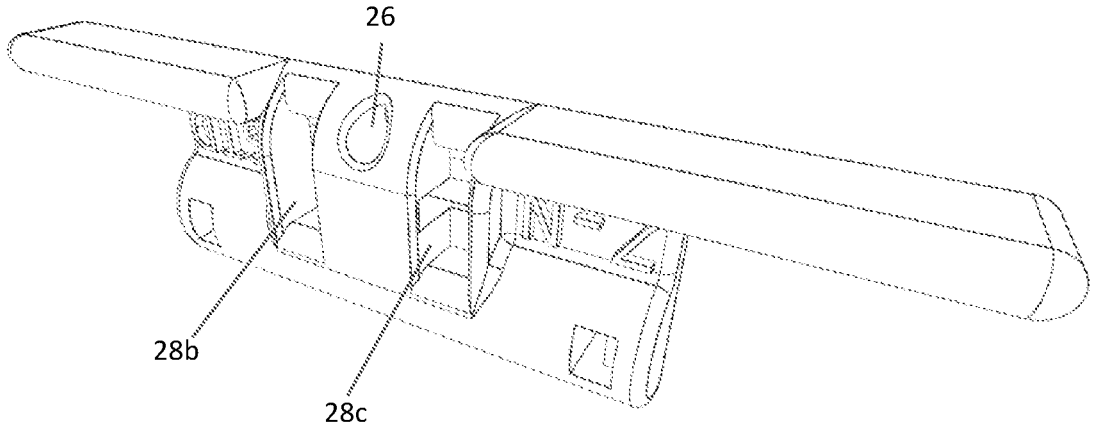
FIGS. 11A, 11B and 11*c* show a second part of the device from various perspectives, wherein the first and second half of the device interlock to result in an assembled device.
Figure 11B:
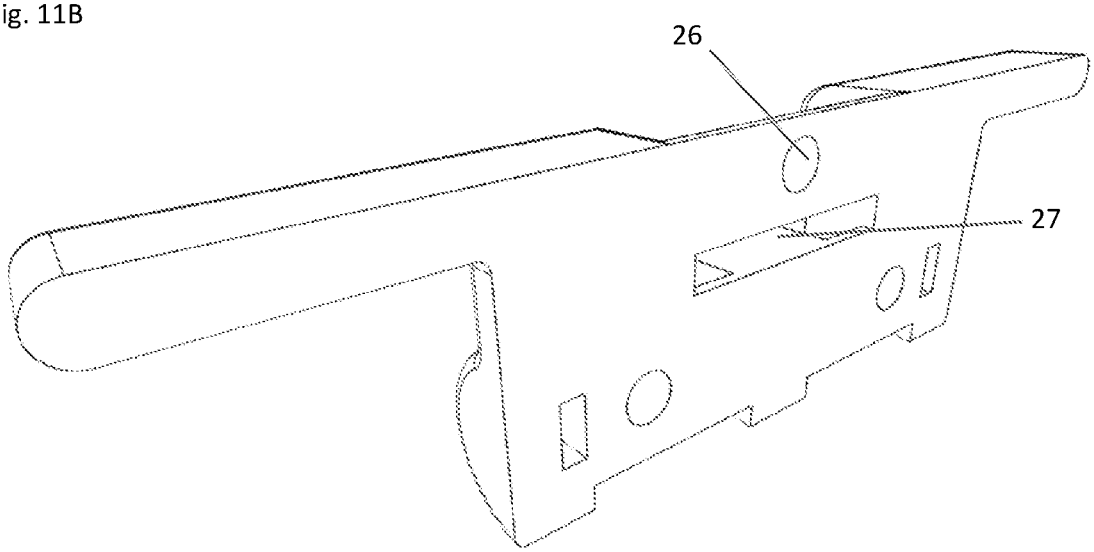
Figure 11C:
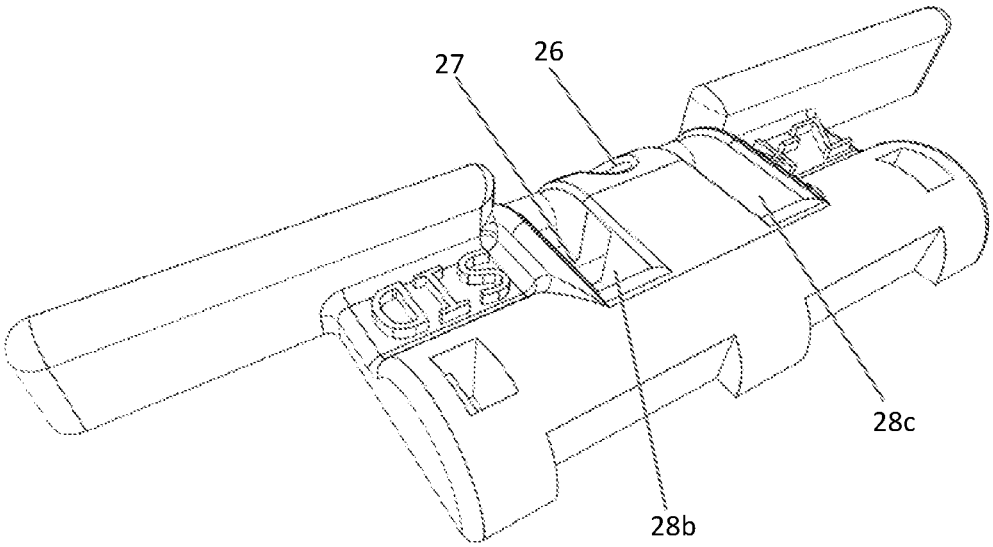
Figure 12A:
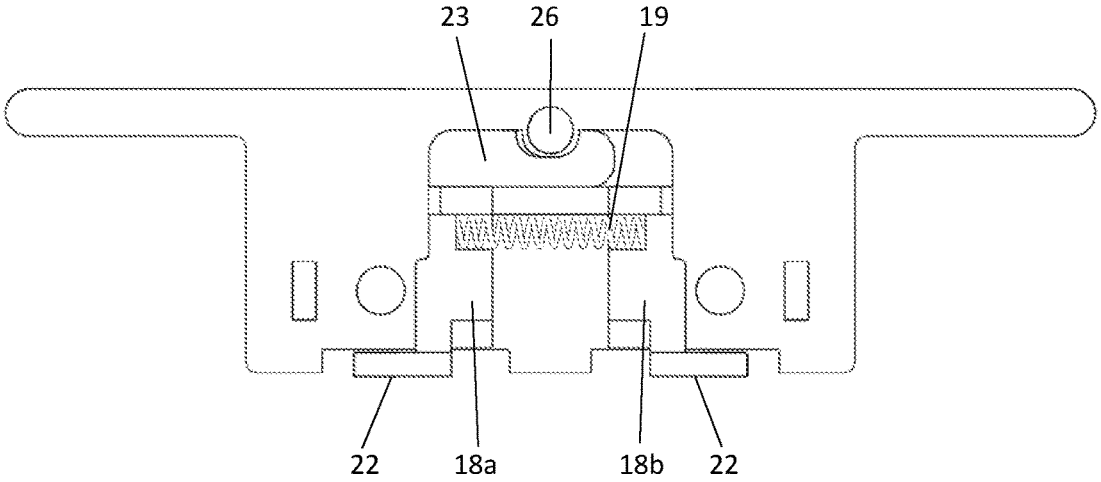
FIGS. 12A and 12B show a cut away view of the device from the side and from the top, respectively.
Figure 12B:
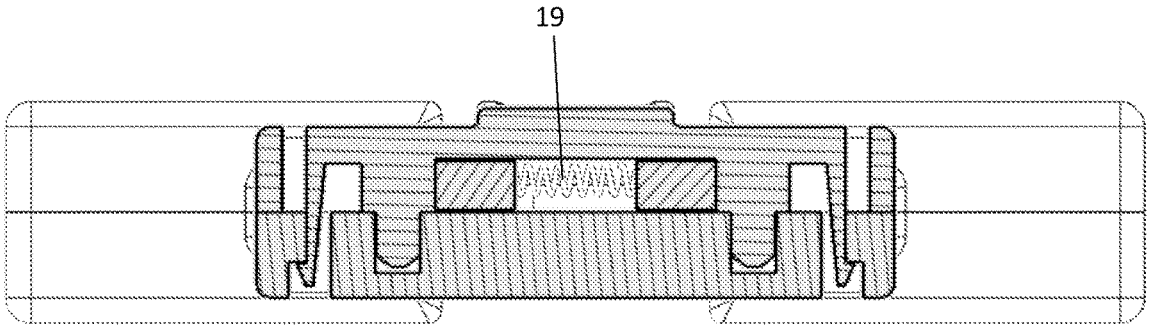
Figure 13A:
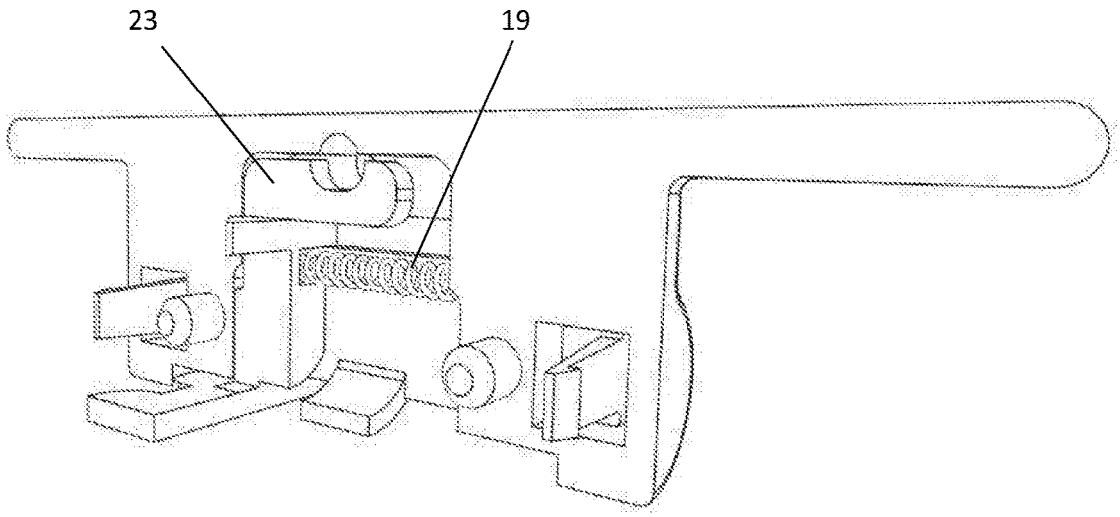
FIG. 13A shows the retaining elements and the resilient member of the device in the engaged position and FIG. 13B shows a retaining element and a resilient member of the device
Figure 13B:
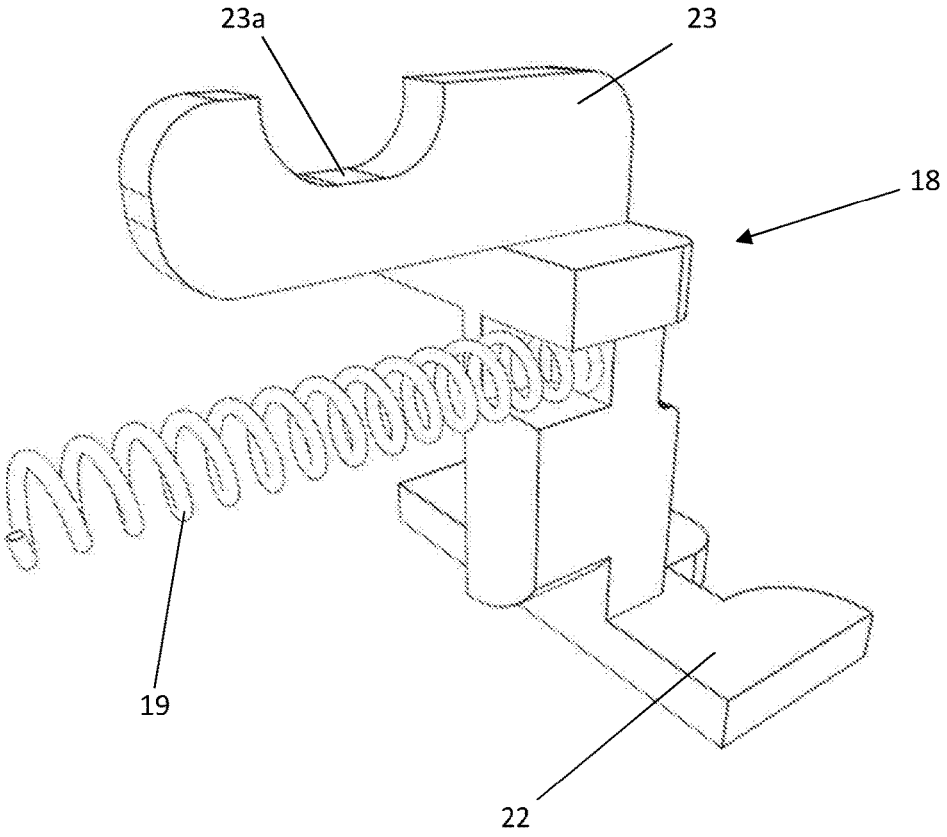

The device (17) comprises a core body (24) and a cover element (28). There is a cavity (25) in the core body (24) for housing the retaining elements (18*a*, 18*b*) and the spring (19). In addition, there is a groove (29) in the cavity (25) which interlocks with the ridge (21*a*) of the retaining elements (18). See FIGS. 10A-10C. The core body (24) further comprises an aperture (27) through which the actuator tabs (20) of the retaining elements (18) protrude when in situ in the core body (24), in both the engaged and released positions. See FIGS. 11A-11C. FIGS. 12A and 12B show the retaining elements (18*a*, 18*b*) and the spring (19) in situ within the cavity (25) in the engaged position. An aperture (26) that runs through the device (17) is visible when the retaining elements are in the engaged position and the indents (23*a*) of the locking tabs (23) align. A padlock or cable tie is placed through this aperture (26) to safely secure the device in the engaged position when it is inserted in a fuse holder (1). See FIG. 14C.

In use, when placed in a fuse holder (1), the retaining elements (18*a*, 18*b*) interact with the metal clips (2) of the fuse holder (1) in the engaged position. The engagement occurs by means of the projections (22*a*, 22*b*, 22*c*) interlocking with the arms of the metal clip (2). Once the foot (22) is engaged with the metal clip (2) it can only disengage if it is slid away from the clip (2), in the direction along the base of the fuse holder (1). The foot (22) cannot be disengaged by pulling the retaining element (18) away from the base of the clip (2), in the direction toward the tip of the clip. The curvature of the clip (2) prevents this movement. Further, when in use in a fuse holder, as shown in FIG. 14C, the cylinder of the core body (24) is inserted into the metal clips (2) of the fuse holder (1). The cylinder expands the metal clips (2) slightly. This expansion further prevents the foot projections (22*a*, 22*b*, 22*c*) from disengaging with the metal clip (2) in the direction starting from the base, moving towards the tip of the clip (2).

Figure 14A:
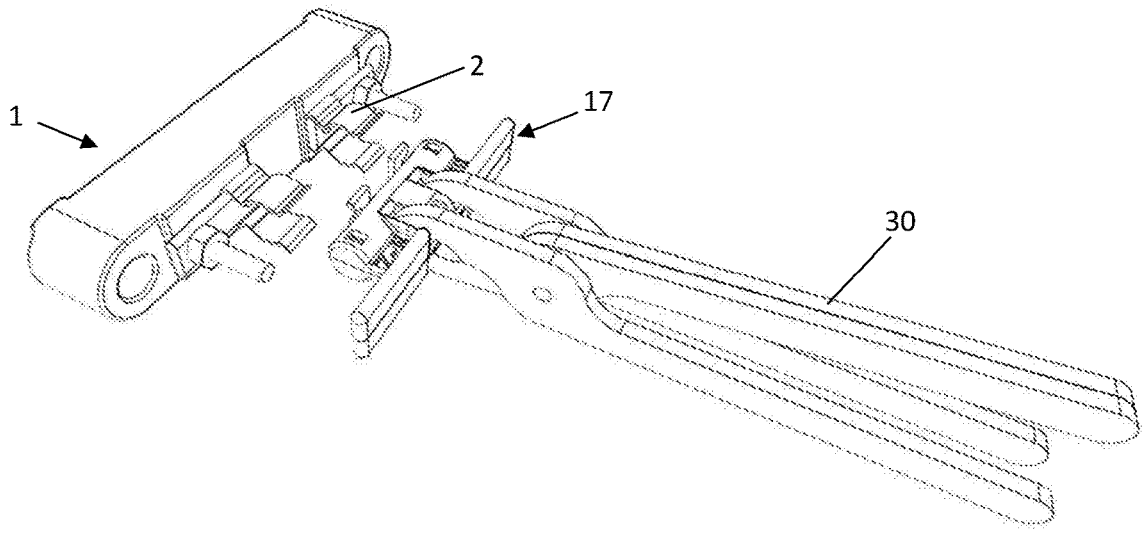
FIG. 14A shows the device in the engaged position before being inserted into the fuse holder and before pressure is applied by the fuse puller.
Figure 14B:
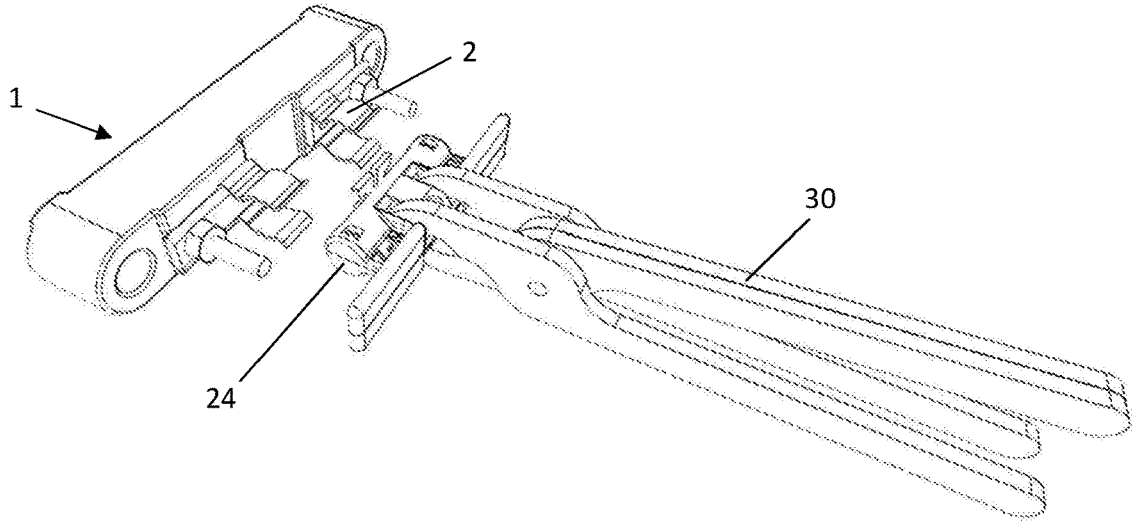
FIG. 14B shows the device in the released position wherein the device is gripped by a fuse puller and the fuse puller has exerted pressure on the actuator tabs.
Figure 14C:
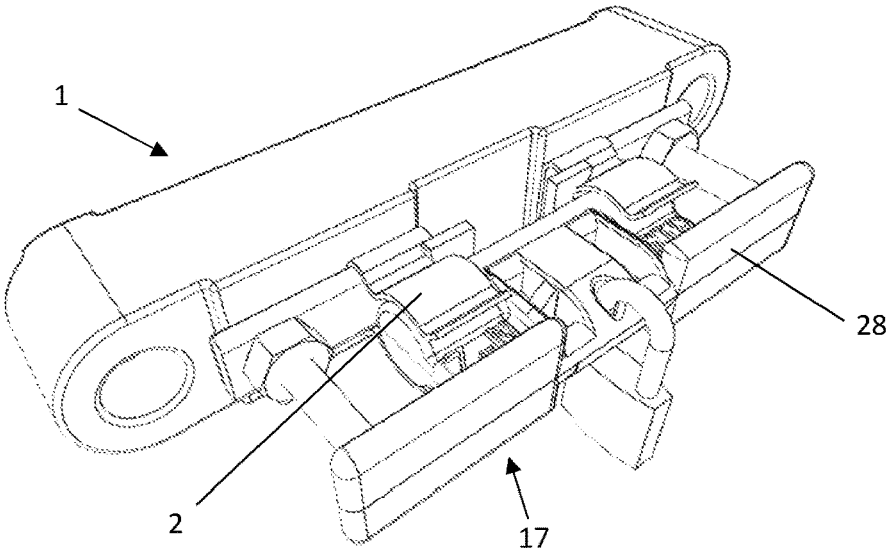
FIG. 14C shows the device in situ in a fuse holder in the engaged position with a locking member.

In use, the device (17) is inserted into and removed from the fuse holder (1) using fuse pullers (30) (see FIGS. 14A and 14B). The fuse pullers (30) grip the core body (24) at demarcated areas (28 *a*, 28 *b*, 28 *c*) where the core body (24) is configured to receive the fuse holder (1) (see FIG. 14B). The actuator tabs (20) of the retaining elements (18) are accessible at two of the demarcated areas (28 *b*, 28 *c*) as they protrude through the aperture (27). Accordingly, on gripping the device, the fuse pullers (30) exert pressure on the actuator tabs (20) of the retaining elements (18). The pressure causes the actuator tabs (20) to slide towards the centre of the cavity (25) within the core body (24) of the device (17). This inward sliding motion is assisted by the angled surface (20 *a*) of the actuator tabs (20). The movement of the actuator tabs (20) of the retaining elements (18 *a*, 18 *b*), compresses the spring (19) between the retaining elements (18 *a*, 18 *b*); the device is in the 'released position'. The device (17) is then placed into the fuse holder (1) such that the cylinder core body (24) is inserted into the metal clips (2) of the fuse holder (1). When the device (17) is in place in the fuse holder (1) the fuse pullers (30) release the device, thereby removing the pressure exerted on the actuator tabs (20). This, in turn, allows the compressed spring (19) to expand, thereby urging the retaining elements (18 *a*, 18 *b*) away from each other, such that the feet projections (22 *a*, 22 *b*, 22 *c*) of the retaining elements (18 *a*, 18 *b*) interdigitate with the arms of the metal clip (2). The device is in the 'engaged position'. The indents (23 *a*) in the locking tabs (23) align with the aperture (26) passing through the device (17). A padlock or a cable tie is passed through the aperture (26) to secure the device (17) in the fuse holder (1).

The device (17) is manufactured by injection moulding. The device (17), specifically the core body (24) and cover (28), are made in two parts as shown in FIGS. 10A-C and 11A-C, respectively, and the retaining elements (18) are made separately. The retaining elements (18) and spring (19) are arranged inside the cavity (25) of the core body (24) and before the two parts are joined together to assemble the device (17).

In a further aspect, the invention provides a safety system (16) for use in safely and securely isolating one or more subsidiary circuits. The circuit is isolated by removal of the cartridge fuse. The safety system (16) prevents the untimely re-insertion of a cartridge fuse into the fuse holder (1) so as to protect operatives working on the isolated circuit.

FIG. 1 shows a safety system (16) comprising two retaining elements (4*a*, 4*b*) and a cover element (3). The retaining elements (4*a*, 4*b*) interact with the cover element (3) and with the metal clips (2) of the fuse holder (1).

Figure 3A:
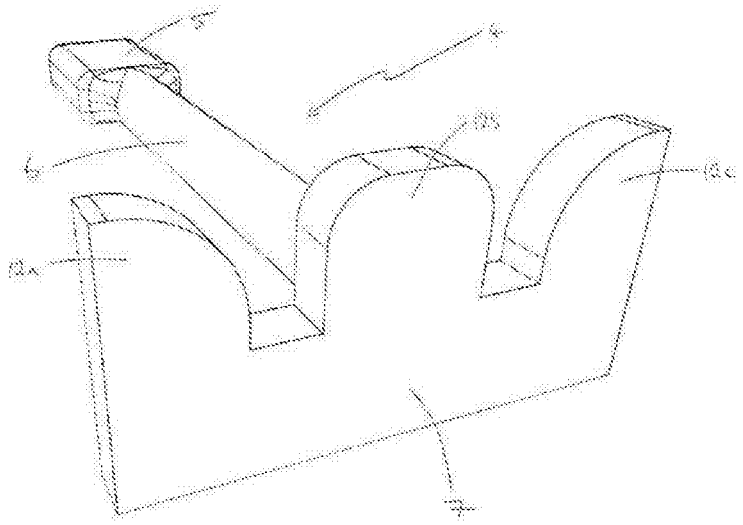
FIGS. 3A, 3B and 3C show a retaining element of the system from various perspectives.
Figure 3B:
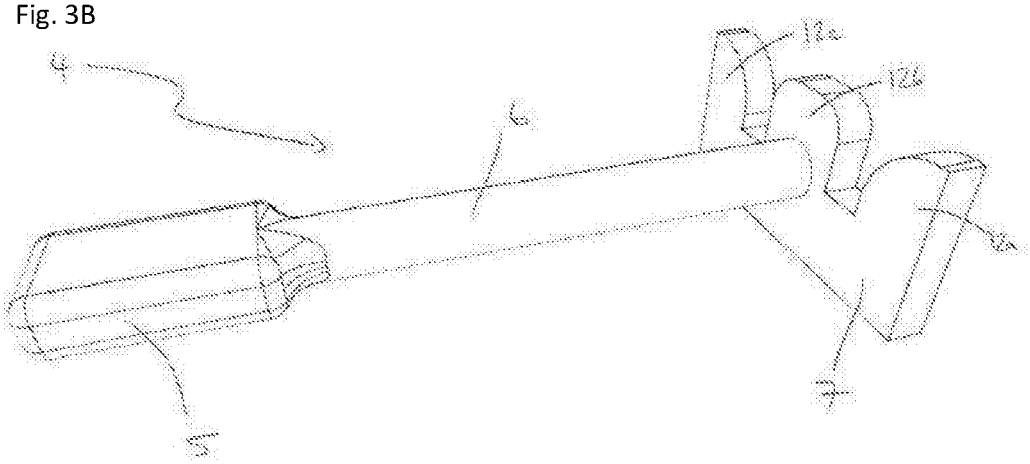
Figure 3C:
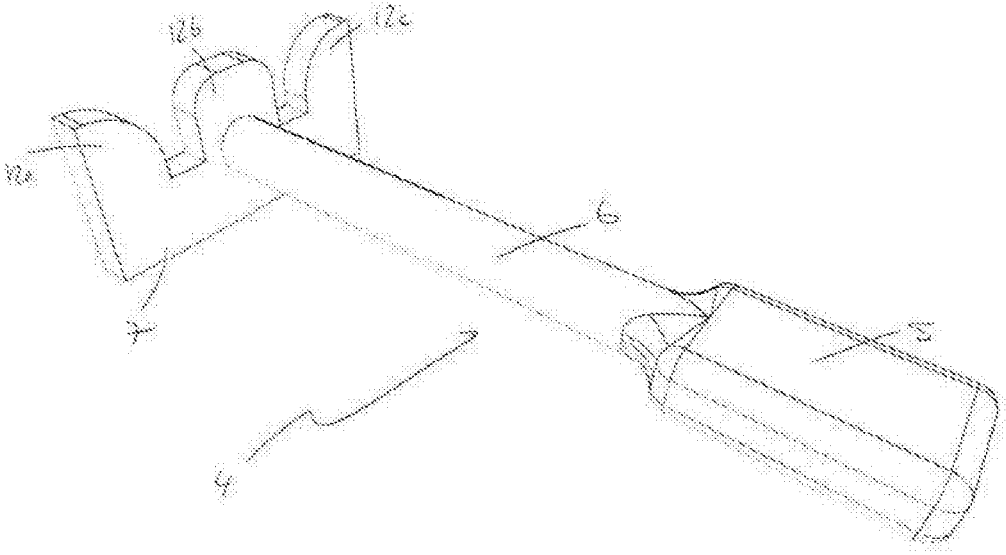

Each retaining element (4) comprises a tab (5), a stem region (6) and a foot (7). The foot comprises three projections (12*a*, 12*b*, 12*c*). (See also FIGS. 3A, 3B and 3C).

Figure 4A:
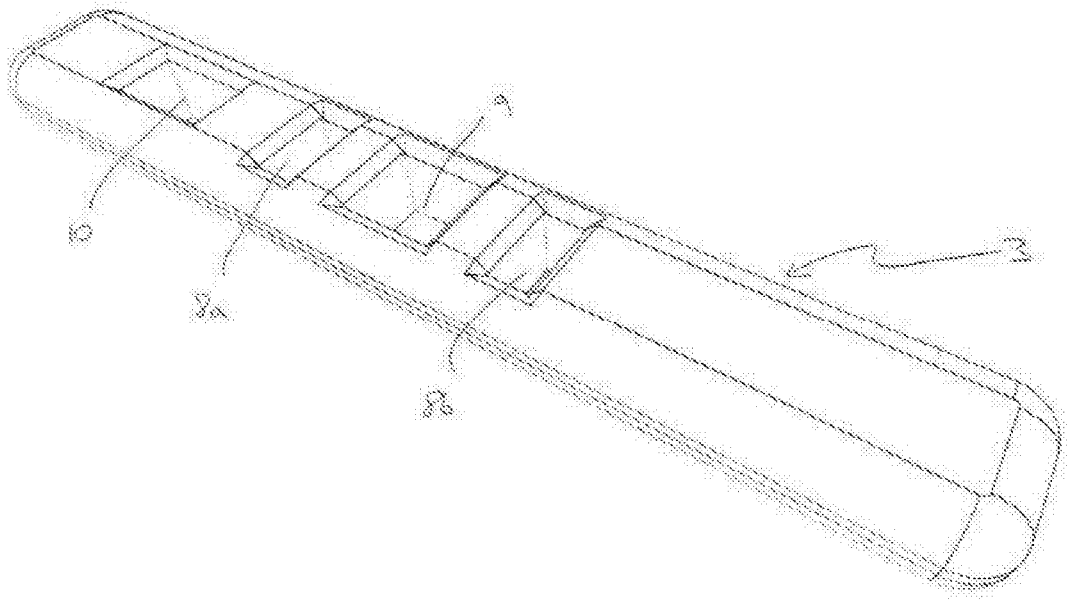
FIGS. 4A and 4B show a cover element from different perspectives.
Figure 4B:
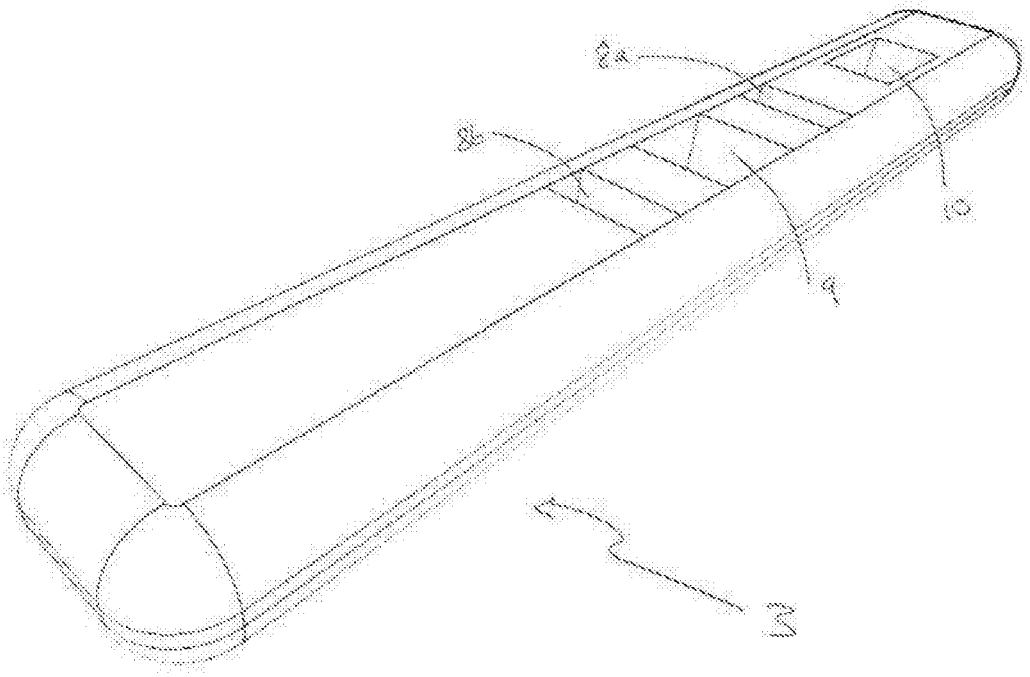
Figure 6:
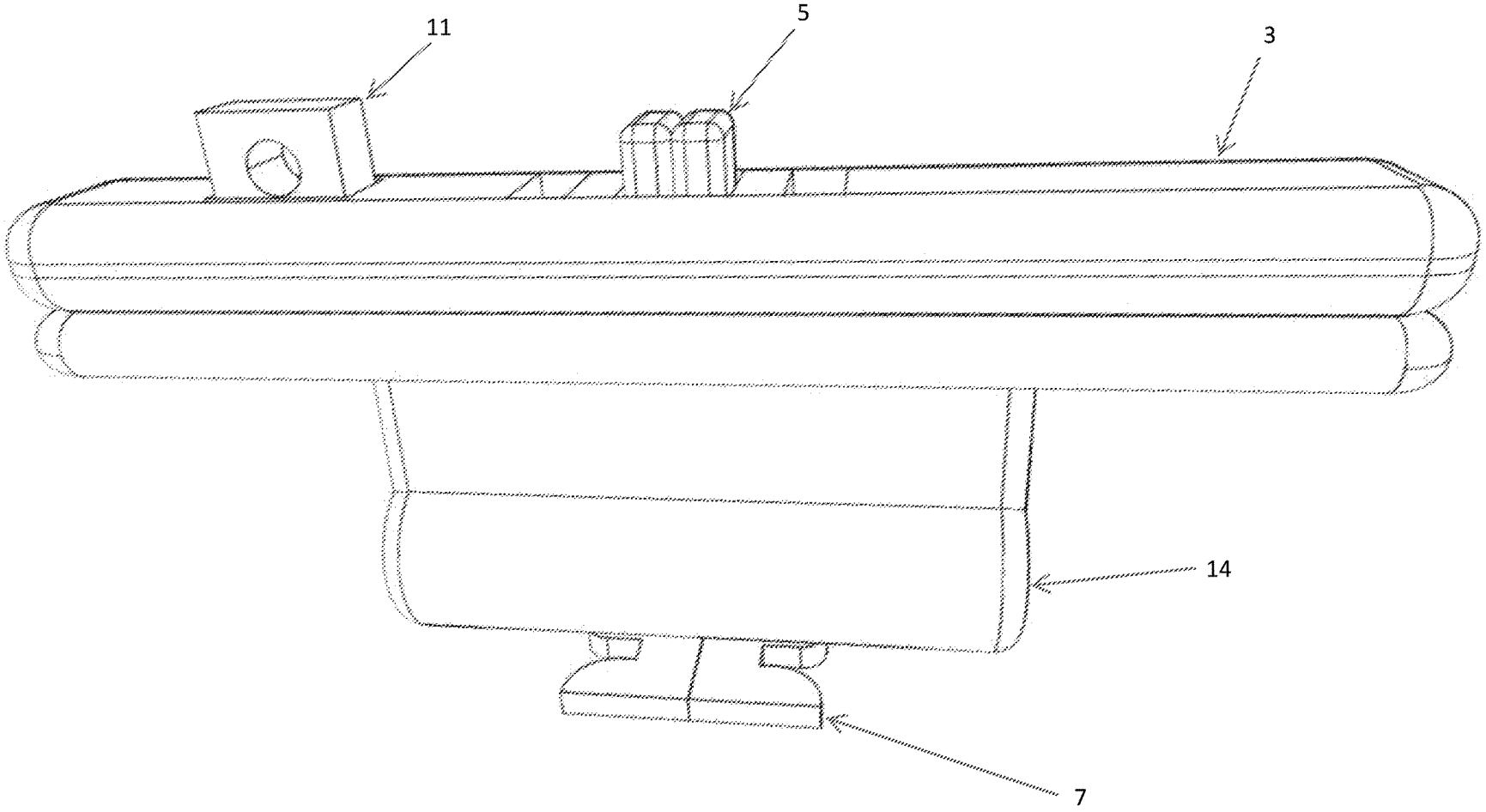
FIG. 6 shows the system of the invention when not in use, i.e., not in a fuse-holder.

The cover element (3) comprises four apertures: two apertures (8*a*, 8*b*) for receiving the retaining elements (4*a*, 4*b*) when the retaining elements (4*a*, 4*b*) are engaged with the metal clips (2) of the fuse holder (1); a central aperture (9) for receiving the retaining elements (4*a*, 4*b*) when the elements are adjacent to each other and not engaged with the fuse holder (1) (as shown in FIG. 6); and a locking aperture (10) for receiving a locking tab (11). (See also FIGS. 4A and 4B)

When in use in a fuse holder, as shown in FIG. 1, the foot (7) of the retaining elements (4*a*, 4*b*) engages with the metal clip (2) of the fuse holder (1). The engagement occurs by means of the projections (12*a*, 12*b*, 12*c*) interlocking with the arms of the metal clip (2). Once the foot (7) is engaged with the metal clip (2) it can only disengage if it is slid away from the clip (2), in the direction along the base of the fuse holder (1). The foot (7) cannot be removed by pulling the retaining element (4) away from the base of the clip (2), in the direction toward the tip of the clip. The curvature of the clip (2) prevents this movement.

The cover element (3) is placed over the retaining elements (4*a*, 4*b*) such that a tab (5) of a retaining element (4*a*, 4*b*) is received in an aperture (8*a*, 8*b*), respectively. The apertures (8*a*, 8*b*) are a specified distance apart so that when the cover element (3) is in contact with the retaining elements (4*a*, 4*b*) via the apertures (8*a*, 8*b*), the retaining elements (4*a*, 4*b*) are positioned such that the foot of each retaining element is engaged with the metal clip (2).

Figure 5A:
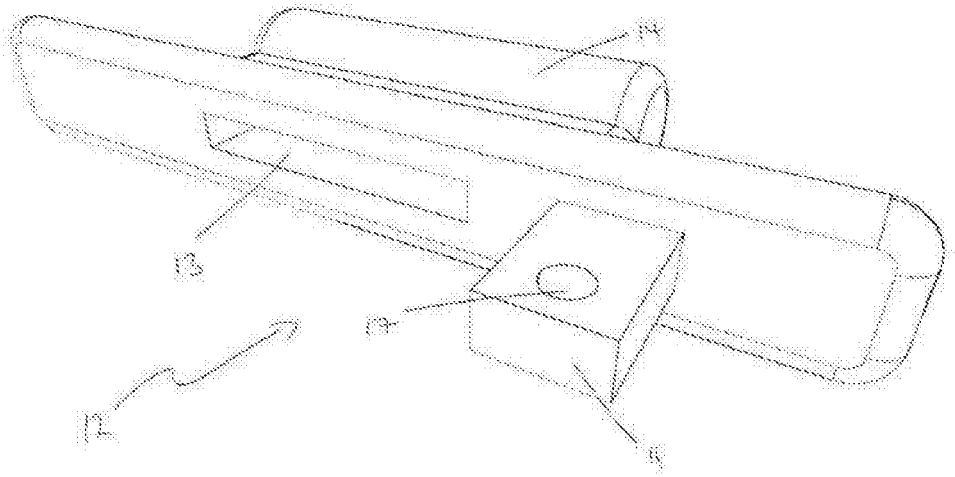
FIGS. 5A, 5B and 5C show a core body comprising a cylindrical element from various perspectives.
Figure 5B:
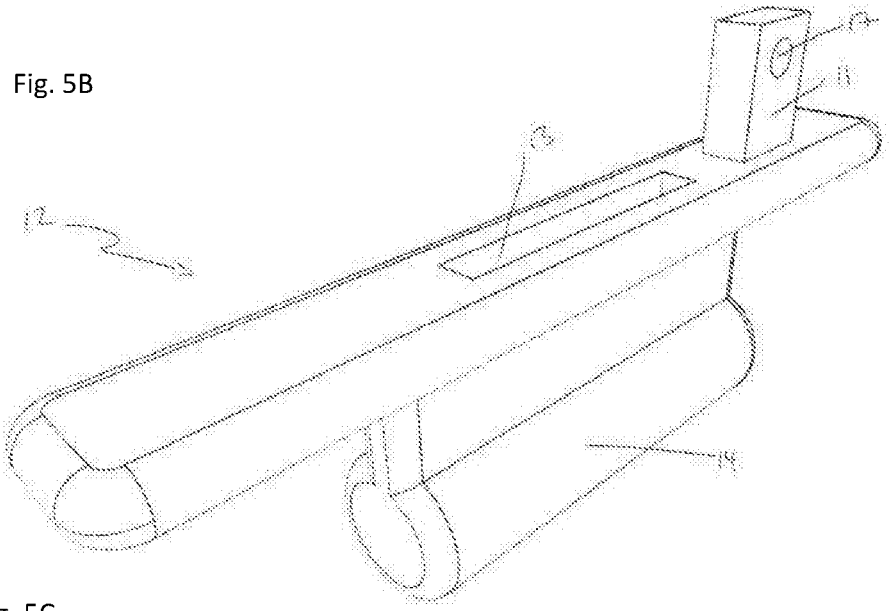
Figure 5C:
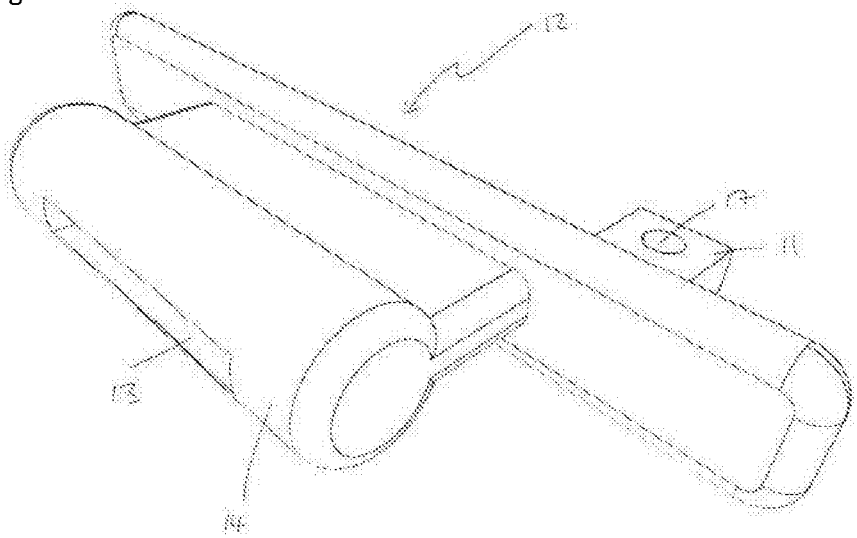

FIGS. 2A and 2B show the safety system (16) of the invention as described above in relation to FIG. 1, when in use in a fuse holder (1). Additionally, the system (16) shown in FIG. 2 comprises a core body (12). The core body (12) comprises a slot (13) that runs through the core body from the underside to the upperside of the core body (12). The core body (12) also comprises a cylindrical element (14) that is connected to a platform element (15). There is a locking tab (11), which comprises a locking aperture, mounted on the platform element (15). (See also FIGS. 5A, 5B and 5C).

When in use in a fuse holder, as shown in FIGS. 2A and 2B, the cylindrical element (14) of the core body (12) is inserted into the metal clips (2) of the fuse holder (1). The cylindrical element (14) expands the metal clips (2) slightly. This expansion further prevents the foot projections (12 *a*, 12 *b*, 12 *c*) from disengaging with the metal clip (2) in the direction starting from the base, moving towards the tip of the clip (2). The stem region (6) of the retaining elements (4

*a*, 4 *b*) is encompassed within the slot (13) of the core body (12). The locking tab (11) is protruding through the locking aperture (10) in the cover element. A padlock is attached (not shown in Figure) through the aperture on the locking tab, thereby securing the system (16) in the fuse holder (1).

FIG. 6 shows the safety system (16), comprising the retaining elements (4*a*, 4*b*), the cover element (3) and the core body (12), when not in use. The retaining elements (4*a*, 4*b*) are held in the central aperture (9). The system (16) is in this configuration when it is inserted into and removed from a fuse holder (1) (see FIG. 7). The positioning of the retaining element s (4*a*,4*b*) avoids the foot (7) being caught up or broken in the metal clip (2) during insertion and removal. The system (16) can be inserted and removed using fuse pullers (not shown in the figures) that grip the core body (12) as they would a cartridge fuse, or manually inserted and removed into and out of the fuse holder by hand.

The system (16) as shown in FIG. 6 is assembled by inserting the retaining elements (4*a*, 4*b*) into the slot (13) of the core body (12). The tab (5) of the retaining element (4) has a cuboid shape and can only be inserted into the slot (13) if the longest dimension of the tab (5) is aligned with the longest dimension of the slot (13). Once the tab (5) has been pushed through the slot (13), the retaining element (4) is rotated by 90° so that the tab (5) cannot pass back through the slot (13). The retaining elements (4*a*, 4*b*) may move back and forth along the length of the slot (13), i.e., from one end of the slot (13) to the other. The retaining elements (4*a*, 4*b*) are gathered next to each other in the centre of the slot (13). The cover element (3) is then introduced: it is placed onto the core body (12) such that the locking tab (11) lines up with the locking aperture (10). The retaining elements (4*a*, 4*b*) are aligned in the slot (13) so that they fit into the central aperture (9). The tabs (5) are oriented correctly to fit into the central aperture (9) after being rotated as described above. The tabs (5) and the aperture (9), and the locking tab (11) and the locking aperture (10), respectively, have a close fit so as to prevent unwanted movement between the elements of the system (16). During storage of the system (16), a padlock (18) may be passed though the locking aperture (16) to retain the elements of the system (16) together.

Figure 7:
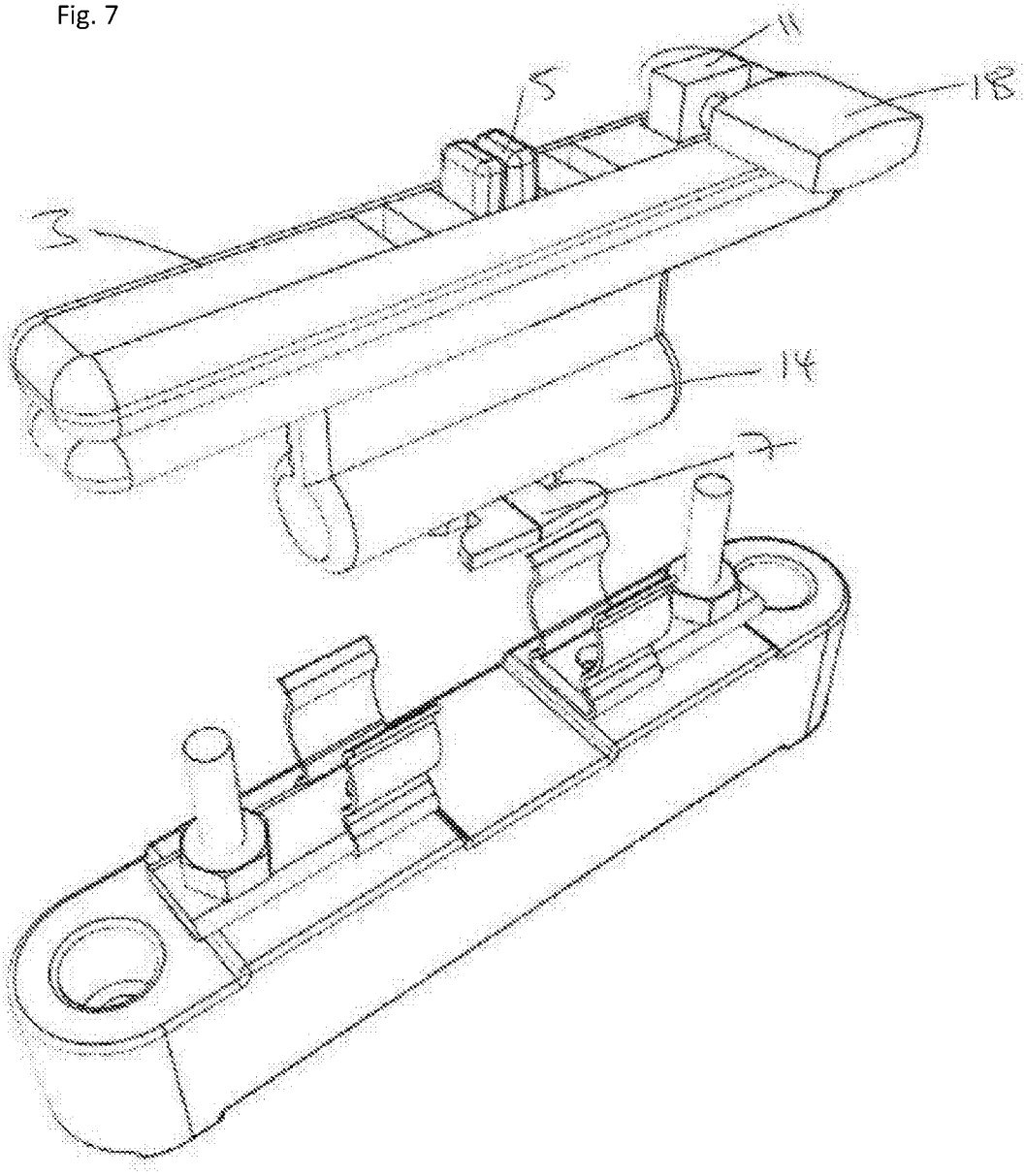
FIG. 7 shows the insertion of the system into a fuse holder.

As mentioned above, the system (16) is in the configuration shown in FIG. 6 when it is inserted into a fuse holder (1) (see FIG. 7). Once inserted, the system (16) is then engaged with the fuse holder (1). The cover (3) is removed and the retaining elements (4*a*, 4*b*) are can slide away from each other, along the slot (13), towards either end of the fuse holder (1). Before the retaining elements (4*a*, 4*b*) are moved, it is important to ensure that the foot (7) and the projections (12*a*, 12*b*, 12*c*) thereon are orientated to engage with the metal clip (2). That is, the projections (12*a*, 12*b*, 12*c*) should be facing the metal clip (2). Once the foot (7) and the projections (12*a*, 12*b*, 12*c*) on each retaining element (4*a*, 4*b*) have engaged with their respective metal clip (2), the cover (3) is reattached. Once again, the locking tab (11) lines up with the locking aperture (10). However, in this instance, the retaining elements (4*a*, 4*b*) align with individual apertures (8*a*, 8*b*). The addition of the cover (3) prevents any relative movement between the two retaining elements (4*a*, 4*b*) as they can no longer slide along the slot (13). Once the system (16) is assembled, a padlock can be passed through the security aperture (17). This serves to secure the cover (3) to the core body (12). Furthermore, as the retaining elements (4*a*, 4*b*) are engaged with the metal clips (2) and are immobilized in place by the core body (12) and cover (3), the locked system (16) cannot be removed from the fuse holder.

The invention claimed is:

1. A fuse insertion prevention device for preventing insertion of a fuse into a fuse holder, comprising:

a plurality of retaining elements configured to engage with the fuse holder, and a resilient member situated between the plurality retaining elements, wherein:

the plurality of retaining elements are moveable relative to each other between an engaged and a released position, such that:

in the engaged position, the resilient member exerts pressure on the plurality of retaining elements thereby urging them apart, and in the released position, the plurality of retaining elements are moved towards each other and the resilient member is compressed, and the fuse insertion prevention device further comprises a core body including a cavity having dimensions configured to:

house a stem region of the plurality of retaining elements and the resilient member, and allow for movement of the plurality of retaining elements encompassed therein in a single plane along a longitudinal axis of the fuse insertion prevention device between the released and engaged positions.

2. The fuse insertion prevention device according to claim 1, wherein the resilient member is a spring.

3. The fuse insertion prevention device according to claim 1, wherein:

each of the plurality of retaining elements comprises an actuator tab, the stem region, and a foot, the actuator tab and the foot are at respective ends of the stem region, and the foot and the actuator tab lie in a plane that is perpendicular to a longitudinal axis of the stem region.

4. The fuse insertion prevention device according to claim 3, wherein:

the fuse insertion prevention device further comprises an aperture, and dimensions of the aperture are such that the actuator tabs of the plurality of retaining elements protrude through the aperture and can move between the released and engaged position.

5. The fuse insertion prevention device according to claim 3, wherein the foot of each of the plurality of retaining elements comprises a plurality of projections that are configured to engage the fuse holder.

6. The fuse insertion prevention device according to claim 3, wherein a leading edge of each of the actuator tabs is angled.

7. The fuse insertion prevention device according to claim 3, wherein:

the fuse insertion prevention device is configured to be gripped by a fuse puller by means of one or more ridges on the outside of the fuse insertion prevention device which demarcate the areas where the fuse puller contacts the fuse insertion prevention device, and the fuse puller is configured to press the actuator tabs of the plurality of retaining elements thereby moving the plurality of retaining elements from the engaged position to the released position.

8. The fuse insertion prevention device according to claim 1, wherein:

the core body is shaped for insertion into the fuse holder, and the core body comprises a cylindrical element or is cylindrical.

9. The fuse insertion prevention device according to claim 1, wherein the plurality retaining elements are configured to engage ends of the fuse holder, respectively.

10. The fuse insertion prevention device according to claim 1, wherein:

the cavity comprises a recessed groove, each of the plurality of retaining elements comprise a ridge, the ridge and the recessed groove interlock and the ridge moves in the recessed groove in a single plane along the longitudinal axis of the fuse insertion prevention device on compression and release of the resilient member, and the ridge protrudes from the stem region of each of the plurality of retaining elements.

11. The fuse insertion prevention device according to claim 1, wherein:

each of the plurality of retaining elements comprises a notch, dimensions of the notch are such that each end of the resilient member sits in the notch of a respective retaining element of the plurality of retaining elements, and the notch is in the stem region of each of the plurality of retaining elements.

12. The fuse insertion prevention device according to claim 1, wherein:

each of the plurality of retaining elements includes a locking tab comprising an indent or hole, the locking tab lies in a plane that is perpendicular to a longitudinal axis of the stem region of each of the plurality of retaining elements, and in the engaged position the indent or hole in each of the locking tabs aligns with an aperture that runs from one side of the core body to another side of the core body, thereby allowing for a securing member to pass through the aperture and fix the plurality of retaining elements in situ in the core body.

13. The fuse insertion prevention device according to claim 1, wherein the fuse insertion prevention device further comprises a cover element.

14. The fuse insertion prevention device according to claim 1, wherein the fuse insertion prevention device is non-conductive.

15. A fuse-insertion prevention method comprising the steps:

providing the fuse insertion prevention device according to claim 1, pressing the actuator tabs of the plurality of retaining elements, thereby moving the plurality of retaining elements towards each other and compressing the resilient member, placing the core body of the fuse insertion prevention device in the fuse holder; and releasing the actuator tabs of the plurality of retaining elements, thereby allowing the resilient member to return to its extended shape and urge the plurality of retaining elements away from each other such that the plurality of retaining elements engage with the respective ends of the fuse holder.

16. A fuse insertion prevention system for preventing insertion of a fuse into a fuse holder, the fuse insertion prevention system comprising:

one or more retaining elements configured to engage with a fuse holder;

a cover element configured to receive and immobilize the one or more retaining elements and prevents the one or more retaining elements from disengaging from the fuse holder, wherein the cover element prevents insertion of a fuse into the fuse holder; and a core body including a slot running through the core body from an underside to an upperside thereof, the slot including dimensions configured such that:

a tab of the one or more retaining elements can pass through the slot in a particular orientation;

a stem region of the one or more retaining elements can rotate on its longitudinal axis within the slot; and a foot of the one or more retaining elements cannot enter the slot, wherein the rotation of the stem region enables the one or more retaining elements to be orientated such that:

the foot engages with the fuse holder, and the tab prevents release of the one or more retaining elements from the slot in the core body.

17. The fuse insertion prevention system according to claim 16, wherein:

the one or more retaining elements comprises a tab, the stem region, and a foot, the tab and the foot are at respective ends of the stem region, and the foot lies in a plane that is perpendicular to a longitudinal axis of the stem region.

18. The fuse insertion prevention system according to claim 16, wherein:

the core body is shaped for insertion into the fuse holder, and the core body comprises a cylindrical element for insertion into the fuse holder.

19. A fuse insertion prevention device for preventing insertion of a fuse into a fuse holder, comprising:

a plurality of retaining elements configured to engage with the fuse holder, and a resilient member comprising a spring, the resilient member situated between the plurality retaining elements, wherein:

the plurality of retaining elements are moveable relative to each other between an engaged and a released position, such that:

in the engaged position, the resilient member exerts pressure on the plurality of retaining elements thereby urging them apart, and in the released position, the plurality of retaining elements are moved towards each other and the resilient member is compressed.

* * * * *